US009879528B2

(12) United States Patent
Pratt et al.

(10) Patent No.: US 9,879,528 B2
(45) Date of Patent: Jan. 30, 2018

(54) SOLENOID ACTUATOR FOR MUD PULSE TELEMETRY

(71) Applicant: EXTENSIVE ENERGY TECHNOLOGIES PARTNERSHIP, Calgary (CA)

(72) Inventors: F. Dale Pratt, Calgary (CA); Kenneth A. Lambe, Calgary (CA)

(73) Assignee: EXTENSIVE ENERGY TECHNOLOGIES PARTNERSHIP, Calgary, Alberta (CA)

( * ) Notice: Subject to any disclaimer, the term of this patent is extended or adjusted under 35 U.S.C. 154(b) by 0 days.

(21) Appl. No.: 15/375,407

(22) Filed: Dec. 12, 2016

(65) Prior Publication Data

US 2017/0167252 A1 Jun. 15, 2017

Related U.S. Application Data

(60) Provisional application No. 62/267,387, filed on Dec. 15, 2015.

(51) Int. Cl.
*E21B 47/18* (2012.01)

(52) U.S. Cl.
CPC ..... *E21B 47/18* (2013.01); *E21B 47/187* (2013.01)

(58) Field of Classification Search
None
See application file for complete search history.

(56) References Cited

U.S. PATENT DOCUMENTS

| | | | |
|---|---|---|---|
| 3,949,354 | A | 4/1976 | Claycomb |
| 3,958,217 | A | 5/1976 | Spinnler |
| 4,216,536 | A | 8/1980 | More |
| 4,386,422 | A | 5/1983 | Mumby et al. |
| 4,401,134 | A | 8/1983 | Dailey |
| 4,515,225 | A | 5/1985 | Dailey |
| 4,699,352 | A | 10/1987 | Mumby |
| 5,103,420 | A | 4/1992 | Avnon et al. |
| 5,115,415 | A | 5/1992 | Mumby et al. |
| 5,333,686 | A | 8/1994 | Vaughan et al. |
| 5,787,052 | A | 7/1998 | Gardner et a. |

(Continued)

OTHER PUBLICATIONS http://www.balseal.G0m/springs.
http://www.beikimco.com.

*Primary Examiner* — Leon-Viet Nguyen
(74) *Attorney, Agent, or Firm* — Heslin Rothenberg Farley & Mesiti P.C.; Victor A. Cardona, Esq.

(57) ABSTRACT

An actuator for a mud pulse telemetry tool. The actuator includes a solenoid-based servo valve with a coil shaft responsive to data transmitted by a data processor. The coil shaft is movable between an extended position and a retracted position. Movement of the coil shaft to the extended position moves a poppet to close a servo orifice thereby preventing mud flow to a main mud pulse valve of the mud pulse telemetry tool. Movement of the coil shaft to the retracted position moves the poppet to open the servo orifice thereby allowing mud flow to actuate the main mud pulse valve. The poppet is connected to a poppet shaft and the poppet shaft cooperates with the coil shaft in a slide hammer mechanism to amplify force provided by the coil shaft against the poppet shaft with linear movement of the coil shaft to the extended position and to the retracted position.

35 Claims, 4 Drawing Sheets

(56) References Cited

U.S. PATENT DOCUMENTS

| | | | | |
|---|---|---|---|---|
| 6,002,643 | A * | 12/1999 | Tchakarov | E21B 47/187 175/50 |
| 6,016,288 | A | 1/2000 | Frith | |
| 7,564,741 | B2 | 7/2009 | Pratt et al. | |
| 7,719,439 | B2 | 5/2010 | Pratt et al. | |
| 8,203,908 | B2 | 6/2012 | Pratt et al. | |
| 2017/0198570 | A1 * | 7/2017 | Lee | E21B 47/187 |

* cited by examiner

SOLENOID ACTUATOR FOR MUD PULSE TELEMETRY

CROSS-REFERENCE TO RELATED APPLICATIONS

This application claims priority from U.S. Provisional Application Ser. No. 62/267,387, filed on Dec. 15, 2015, the entire disclosure of which is incorporated herein by reference in its entirety.

FIELD OF THE INVENTION

The invention relates generally to a telemetry system, and in particular to a telemetry system for transmitting data generated by a measurement-while-drilling system. More particularly, the present invention relates to a solenoid-based actuator for a downhole mud pulser for sending information from downhole to surface.

BACKGROUND OF THE INVENTION

The desirability and effectiveness of well logging systems where information is sensed in the well hole and transmitted to the surface through mud pulse telemetry has long been recognized. Mud pulse telemetry systems provide the driller at the surface with means for quickly determining various kinds of downhole information, most particularly information about the location, orientation and direction of the drill string at the bottom of the well in a directional drilling operation. During normal drilling operations, a continuous column of mud is circulating within the drill string from the surface of the well to the drilling bit at the bottom of the well and then back to the surface. Mud pulse telemetry repeatedly restricts the flow of mud to generate a pressure increase measured at surface directly proportional to the flow restriction downhole to propagate pressure signals encoding data generated by downhole sensors through the mud upward to the surface.

A telemetry system may be lowered on a wireline located within the drill string, but is usually formed as an integral part of a special drill collar inserted into the drill string near the drilling bit. The basic operational concept of mud pulse telemetry is to intermittently restrict the flow of mud as it passes through a downhole telemetry valve, thereby creating a pressure pulse in the mud stream that travels to the surface of the well. The information sensed by instrumentation in the vicinity of the drilling bit is encoded into a digital formatted signal and is transmitted by instructions to pulse the mud by intermittently actuating the telemetry valve, which restricts the mud flow in the drill string, thereby transmitting pulses to the well surface where the pulses are detected and transformed into electrical signals which can be decoded and processed to reveal transmitted information.

Representative examples of previous mud pulse telemetry systems are described in U.S. Pat. Nos. 3,949,354; 3,958,217; 4,216,536; 4,401,134; and 4,515,225, each of which is incorporated herein by reference in its entirety.

Representative samples of mud pulse generators may be found in U.S. Pat. Nos. 4,386,422; 4,699,352; 5,103,420; and 5,787,052, each of which is incorporated herein by reference in its entirety.

A servo-based actuator for a downhole pulser is described in U.S. Pat. Nos. 8,203,908 and 7,564,741, each of which is incorporated herein by reference in its entirety. A rotary pulser is described in U.S. Pat. No. 7,719,439, incorporated herein by reference in entirety.

A telemetry system capable of performing the desired function with minimal control energy is desirable, since the systems are typically powered by finite-storage batteries. One such example is found in U.S. Pat. No. 5,333,686 (incorporated herein by reference in its entirety), which describes a mud pulser having a main valve biased against a narrowed portion of the mud flowpath to restrict the flow of mud, with periodic actuation of the main valve to allow mud to temporarily flow freely within the flowpath. The main valve is actuated by a pilot valve that can be moved with minimal force. The pilot valve additionally provides for pressure equalization, thereby increasing the life of downhole batteries.

Another example of an energy-efficient mud pulser is described in U.S. Pat. No. 6,016,288 (incorporated herein by reference in its entirety), the mud pulser has a DC motor electrically powered to drive a planetary gear which in turn powers a threaded drive shaft, mounted in a bearing assembly to rotate a ball nut lead screw. The rotating threaded shaft lifts the lead screw, which is attached to the pilot valve.

Stepper motors have been used in mud pulsing systems, specifically, in negative pulse systems (see for example U.S. Pat. No. 5,115,415, incorporated herein by reference in its entirety). The use of a stepper motor to directly control the main pulse valve, however, requires a large amount of electrical power, possibly requiring a turbine generator to supply adequate power to operate the system for any length of time downhole. Such systems also require complicated electronics to commutate the motors.

SUMMARY OF THE INVENTION

One aspect of the present invention is an actuator for a mud pulse telemetry tool, the actuator comprising a solenoid-based servo valve with a bidirectional voice coil and a coil shaft connected to the voice coil, the coil shaft responsive to data transmitted by a data processor, the coil shaft movable between an extended position and a retracted position, wherein movement of the coil shaft to the extended position moves a poppet to close a servo orifice thereby preventing mud flow to a main mud pulse valve of the mud pulse telemetry tool and movement of the coil shaft to the retracted position moves the poppet to open the servo orifice thereby allowing mud flow to actuate the main mud pulse valve, wherein the poppet is connected to a poppet shaft and the poppet shaft cooperates with the coil shaft in a slide hammer mechanism to amplify force provided by the coil shaft against the poppet shaft with linear movement of the coil shaft to the extended position and to the retracted position.

Another aspect of the invention is an actuator for a mud pulse telemetry tool, the actuator comprising a solenoid-based servo valve with a bidirectional voice coil and a coil shaft connected to the voice coil, the coil shaft responsive to data transmitted by a data processor, the coil shaft movable between an extended position and a retracted position, wherein movement of the coil shaft to the extended position moves a poppet to close or restrict an orifice of the mud pulse telemetry tool and movement of the coil shaft to the retracted position moves the poppet to open the orifice thereby allowing mud flow to actuate the mud pulse valve, wherein the poppet is connected to a poppet shaft and the poppet shaft cooperates with the coil shaft in a slide hammer mechanism to amplify force provided by the coil shaft against the poppet shaft with linear movement of the coil shaft to the extended position and to the retracted position.

Another aspect of the invention is an actuator for a mud pulse telemetry tool, the actuator comprising a solenoid-based servo valve with a bidirectional voice coil and a coil shaft connected to the voice coil, the coil shaft responsive to data transmitted by a data processor, the coil shaft movable between an extended position and a retracted position, wherein movement of the coil shaft to the extended position moves a poppet to close a servo orifice thereby preventing mud flow to a main mud pulse valve of the mud pulse telemetry tool and movement of the coil shaft to the retracted position moves the poppet to open the servo orifice thereby allowing mud flow to actuate the main mud pulse valve, wherein the poppet is connected to a poppet shaft and the poppet shaft cooperates with the coil shaft in a slide hammer mechanism to amplify force provided by the coil shaft against the poppet shaft with linear movement of the coil shaft to the extended position and to the retracted position, wherein a portion of the poppet shaft resides in a latch housing which cooperates with one or more shaped portions of the poppet shaft in providing a latch mechanism for retaining the poppet shaft in the extended position or the retracted position.

In some embodiments of the actuator, the coil shaft has an outer end with a hollow portion defined by an end wall and an opposing hooked end and the poppet shaft has a block dimensioned to slide within the hollow portion of the coil shaft between the end wall of the coil shaft and the opposing hooked end of the coil shaft, wherein impact of the end wall against the block resulting from movement of the coil shaft to the extended position increases the force provided by the coil shaft on the poppet shaft during closure of the servo orifice and wherein impact of the hooked end of the coil shaft against the block resulting from movement of the coil shaft to the retracted position increases the force of the coil shaft against the poppet shaft during opening of the servo orifice.

In some embodiments of the actuator, the hollow portion of the coil shaft has an opening of sufficient size to allow insertion of the block of the poppet shaft, thereby facilitating assembly of the servo valve.

In some embodiments of the actuator, the actuator further comprises a latch housing for the outer end of the coil shaft and the poppet shaft, the housing cooperating with one or more shaped portions of the poppet shaft in providing a latch mechanism for retaining the poppet shaft in the extended position or the retracted position.

In some embodiments of the actuator, the latch housing includes a circumferential cavity holding a coil spring and the poppet shaft includes a circumferential indentation configured to retain the spring therewithin with a spring-biasing force when the latch mechanism is engaged, thereby arresting linear movement of the poppet shaft.

In some embodiments of the actuator, the latch mechanism is engaged when the poppet shaft is in the retracted position and the servo orifice is closed.

In some embodiments of the actuator, the poppet shaft includes a downward slope away from the circumferential indentation, wherein cooperation of biasing force of the coil spring against the downward slope biases movement of the poppet shaft to the extended position.

In some embodiments of the actuator, the actuator further comprises a pressure compensating sealing device defining a boundary between an oil-containing cavity and a mud-containing cavity, the sealing device configured to move in response to changes in mud pressure and to allow linear movement of the poppet shaft.

In some embodiments of the actuator, the sealing device has an interior mud-contacting surface formed of an elastomeric material which flexes in response to increased mud pressure.

In some embodiments of the actuator, the sealing device includes a flexible seal allowing entrance of mud to the mud contacting surface while preventing entrance of particulate matter to the mud contacting surface.

In some embodiments of the actuator, the sealing device includes a rigid seal forming a barrier between the oil-containing cavity and the mud-containing cavity and a second flexible seal adjacent the rigid seal.

In some embodiments of the actuator, the voice coil is configured for movement within an actuator core comprising a rare earth magnet.

BRIEF DESCRIPTION OF THE DRAWINGS

Various objects, features and advantages of the invention will be apparent from the following description of particular embodiments of the invention, as illustrated in the accompanying drawings. The drawings are not necessarily to scale, emphasis instead being placed upon illustrating the principles of various embodiments of the invention. Similar reference numerals indicate similar components.

DETAILED DESCRIPTION OF THE INVENTION

Rationale

Figure 1A:
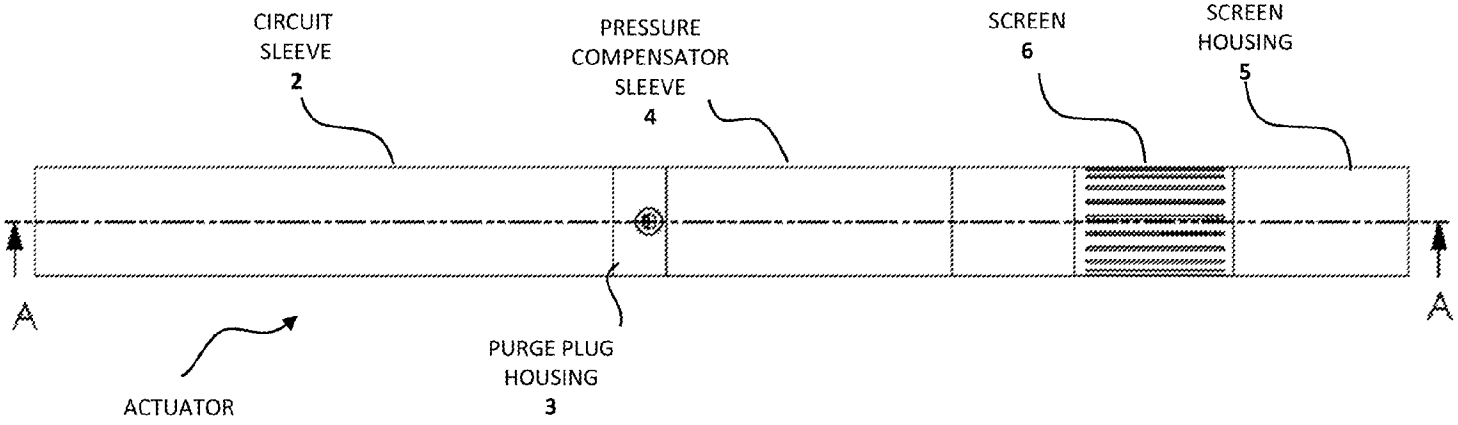
FIG. 1A is a side elevation view of one embodiment of an actuator 10.

Downhole tools are typically battery powered, unreliable, and overcomplicated. This tends to increase costs of operation and maintenance. In mud pulse telemetry systems, pulse actuators have improved to become more efficient using stepper motors and brushless DC motors to move in response to digital signals. However, there remains a need for simpler and more cost effective pulser actuators which use less energy and require less maintenance.

Well service companies require low cost solutions to a number of downhole measurement problems, such as problems encountered with pulser actuators used in mud pulse telemetry which are required to operate unattended for extended periods in harsh conditions of high pressures, temperatures and vibrations.

Solenoid-type pulser actuators have also been used to actuate the main pulser valve, however, a number of problems have been recognized as being associated with solenoid-based systems. The use of a spring to bias the solenoid requires the actuator (servo) valve to overcome the force of the spring (about 6 pounds) and the force of mud pressure also most be overcome to actuating the main orifice valve. A further problem with the use of a solenoid to actuate the pulser assembly is the limited speed of response and recovery that is typical of solenoid systems. Following application of a current to a solenoid, there is a recovery period during which the magnetic field decays to a point at which it can be overcome by the force of the solenoid's own return spring to close the servo-valve. This delay results in a maximum data rate (pulse width) of approximately 0.8 seconds/pulse, limiting the application of the technology.

Moreover, the linear alignment of the solenoid must be exactly tuned (i.e. the magnetic shaft must be precisely positioned within the coil) in order to keep the actuator's power characteristics within a reliable operating range. Therefore, inclusion of a solenoid within the tool adds complexity to the process of assembling and repairing the pulser actuator, and impairs the overall operability and reliability of the system.

Existing tools are also prone to jamming due to accumulation of debris, reducing the range of motion of the pilot valve. Particularly when combined with conditions of high mud flow, the power of the solenoid is unable to clear the jam, and the tool is rendered non-functional. The tool must then be brought to the surface for service.

Repair of damage to existing pulsers represents an unresolved problem. Typically, the entire tool is contained within a single housing, making access and replacement of small parts difficult and time-consuming. Furthermore, a bellows seal within the servo-poppet of the servo valve has typically been the only barrier between the mud flowing past the pilot valve's poppet and the pressurized oil contained within the servo-valve actuating tool, which is required to equalize the hydrostatic pressure of the downhole mud with the tool's internal spaces. Therefore, in order to dissemble the tool for repair, the bellows seal must be removed, causing the integrity of the pressurized oil chamber to be lost at each repair.

Furthermore, a key area of failure of measurement-while-drilling pulser drivers has been the failure of the bellows seal around the servo-valve activating shaft, which separates the drilling mud from the internal oil. In existing systems, the addition of a second seal is generally not feasible, particularly in servo-drivers in which the servo-valve is closed by a spring due to the limited force which may be exerted by the spring, which is in turn limited by the available force of the solenoid, and cannot overcome the friction or drag of an additional static/dynamic linear seal.

It remains desirable within the art to provide a pulse generator that has sufficient energy efficiency to operate reliably and to adapt to a variety of hostile downhole conditions, as well as reduced susceptibility to jamming by debris and simplicity with respect to routine repair.

The present inventors have recognized that a mud pulse telemetry actuator can be constructed to ameliorate at least some of the problems outlined above. Embodiments of the invention include a bidirectional solenoid actuator with a slide hammer mechanism to increase the force provided by the actuator. This simpler system reduces manufacturing costs by requiring fewer parts. Certain embodiments employ a voice coil which provides a high level of torque. Certain embodiments include a latching system that provides a means to retain the actuator in one position without requiring energy input. Other embodiments include a pressure compensator system to prevent excess stress on certain components of the actuator system.

Operational Overview

The main operator of the actuator is a bidirectional solenoid that has a coil shaft which is extendable and retractable for the purpose of closing and opening an actuator valve. The actuator valve is provided as either a servo valve embodiment which controls opening and closing of a main valve that generates mud pulses encoding downhole data, or as a main actuator embodiment mechanism which directly controls opening and closure or restriction of a mud pulse valve. The servo valve may be used to retrofit existing mud pulse telemetry tools by replacing servo valves based on motors or other types of actuators.

The solenoid coil moves as a result of application of a polarized DC voltage pulse. The polarity and pulse duration are controlled via a microcontroller which provides timing and logic output based on inputs from the measurement-while-drilling system.

The mass of the moving coil is amplified using a "slide hammer" mechanism to overcome static friction to move a poppet shaft. A latching system holds the shaft in a biased closed or open position and uses the static energy of the latch to hold the shaft in one of the two positions.

The acceleration of the movement of the coil in combination with the slide hammer mechanism generates sufficient force to overcome the static friction of the latched poppet shaft.

In the opposite movement, the coil is energized with a reverse polarity to move the coil to force the poppet shaft towards the latched position. The slide hammer mechanism provides similar force amplification in allowing the coil to reach a maximum acceleration speed before contacting the poppet shaft overcoming the static force of the latch.

The system efficiency is recognized in the rapid acceleration of the coil mass applying a short DC current pulse to the coil wires. The slide hammer mechanism amplifies the net force according to the formula force=mass×acceleration. Since the mass is a fixed amount, the acceleration can be altered to effectively increase the force applied.

The force required to hold the poppet in position away from the valve uses the static inherent force of the latching system. The efficiencies are realized as the latch eliminates requirement to electrically hold the shaft in position with electromagnetic force (as used in conventional systems) and the slide hammer mechanism amplifies the force which is required to overcome the latching force. The relatively short configuration with minimal moving parts and basic electronics reduces complexity and costs relative to existing servo valve systems of mud pulse telemetry tools.

Some embodiments of the invention include a pressure compensator to equalize internal pressure in the tool compartment holding the actuator to the hydrostatic pressures exerted by the outside mud weight. The pressure compensator moves to an equilibrium position as the pressures equalize.

Definitions

As used herein, the term "measurement-while-drilling" refers to any measurement obtained from sensors associated with well drilling equipment As used herein, the term "mud pulse telemetry" refers to a process using valves to modulate the flow of drilling fluid in the bore of the drill string, generating pressure pulses that transmit information to the surface as a result of the non compressible fluid acting on the entire fluid column essentially instantaneously.

As used herein, the term "actuator" refers to a system which supplies or transfers energy for operation of a device.

As used herein, the term "servo" is used as an adjective to indicate a component acting as a part of a servomechanism. A "servomechanism" is an electronic control system in which a main controlling mechanism is actuated by a secondary system which uses less energy.

As used herein, the term "slide hammer" refers to tool configured to transmit an impact force to an object to amplify the impact force. A typical slide hammer arrangement is a long metal shaft with an attachment point at one end, a weight configured to slide in the same axis as the shaft and a stop for the weight to impact the end opposite the attachment point. Slide hammers are most often used for loosening or pulling apart tightly coupled parts.

As used herein, the terms "mud," "drilling mud" or "drilling fluid" are synonymous and refer to water-based or oil-based suspensions of clays and other chemical components which are pumped into an oil well during drilling in order to seal off porous rock layers, equalize the pressure, cool the drill bit, and flush out the cuttings.

As used herein, the term "voice coil" refers to a coil of wire functioning in a solenoid for the purpose of serving as an actuator of linear motion.

As used herein, the term "solenoid" refers to a coil whose length is substantially greater than its diameter, often wrapped around a metallic core, which produces a uniform magnetic field in a volume of space when an electric current is passed through it.

As used herein, the term "H-bridge" refers to an electronic circuit that enables a voltage to be applied across a load in either direction.

Description of Embodiments

Various aspects of the invention will now be described with reference to the figures. For the purposes of illustration, components depicted in the figures are not necessarily drawn to scale. Instead, emphasis is placed on highlighting the contributions of the components to the functionality of various aspects of the invention. A number of possible alternative features are introduced during the course of this description. It is to be understood that, according to the knowledge and judgment of persons skilled in the art, such alternative features may be substituted in various combinations to arrive at different embodiments of the present invention.

The present invention relates to an apparatus and method for actuating a mud pulse telemetry system used during well-drilling operations. It is known in the art to provide a servo valve system to control a main pulser valve for initiating a flow restriction in a main orifice to generate series of pulses which encode data recorded by downhole sensors. The embodiments of the invention described herein pertain generally to the servo valve system which may be modified to act as the primary valve system for generating mud pulses and therefore, in the interest of preserving clarity, the details regarding the data encoding control system and the main pulser valve are not described in detail herein. Examples of such are described, for example, in U.S. Pat. No. 5,333,686 and U.S. Pat. No. 8,203,908, each of which is incorporated herein by reference in entirety).

The skilled person will recognize that the servo actuator valve described herein is intended to be used as a replacement for the servo actuator systems of mud pulse telemetry systems known in the art, such as the servo systems of U.S. Pat. No. 5,333,686 and U.S. Pat. No. 8,203,908 which are based on rotary motors or solenoid valves of more basic construction. The function of the servo actuator valve is to receive coded signals representing measurement data and to control the opened/closed state of a servo orifice on the basis of the signals in order to generate mud flow for actuating a downstream main pulser valve which either opens or restricts mud flow to generate mud pulses that encode the data.

An alternative embodiment described hereinbelow is based on the same general operating principles of the servo valve actuator system with the distinction being that only one system is used to receive the coded signals and to actuate the main pulser valve. As such, the invention may be used as a retro-fit modification to replace a servo valve actuator in a "dual valve" system which includes a servo valve and a main valve, or as the basis of a single valve actuator system.

Servo Valve Actuator System

In FIG. 1A, there is shown a side elevation view of one particular example embodiment of a servo valve actuator 10 which is configured for operation with a mud pulse telemetry system (not shown). The bidirectional solenoid-based servo valve-driven actuator controls a main pulser valve of the mud pulse telemetry tool. The data pulse controller and main pulser valve components are not shown and electrical lines are omitted to preserve clarity.

Figure 1B:
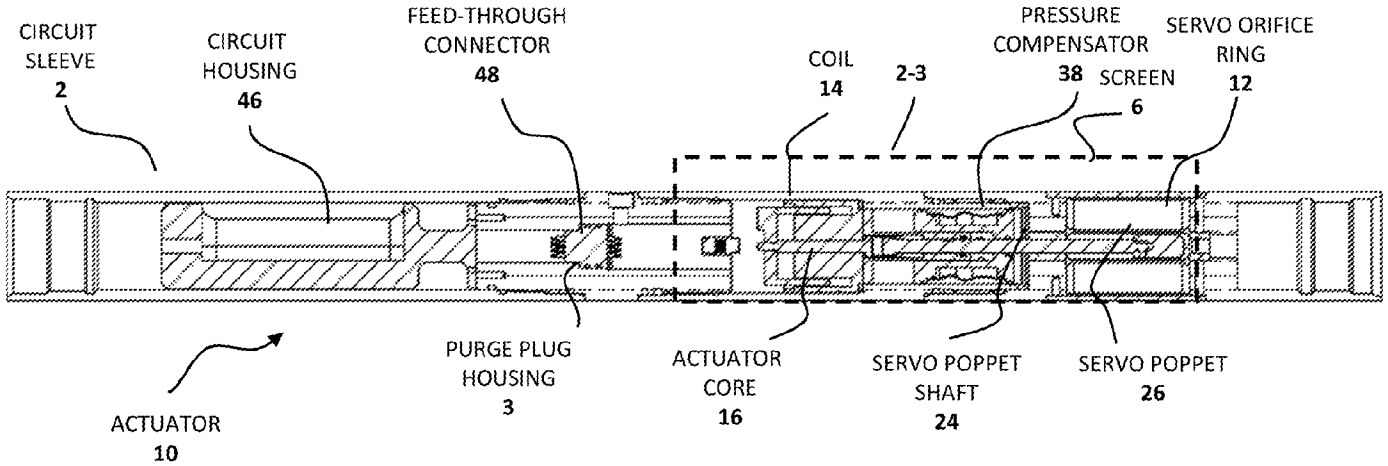
FIG. 1B is a cross section of the actuator 10 taken along line A-A of FIG. 1A.

The side elevation view of FIG. 1A indicates that the actuator 10 includes a series of outer sleeves or housings to protect the mechanical and electronic components contained therein, which are indicated in the cross sectional view of in FIG. 1B (taken along line A-A). The sleeves/housings include (i) a circuit sleeve 2 which includes a circuit housing 46 for protection of circuits used in electronic control of the actuator 10, (ii) a purge plug housing 3 connected to the circuit sleeve 2 for holding a feed through connector 48 (to feed wires to the coil 14), (iii) a pressure compensator sleeve 4 connected to the purge plug housing 3 for holding the coil 14 and actuator core 16 of the bidirectional solenoid and a pressure compensator 38, and (iv) a screen housing 5 for mounting a screen 6 which allows mud flow therethrough. It is further seen in the cross sectional view of FIG. 1B that a servo poppet shaft 24, a servo poppet 26 and a servo orifice ring 12 are contained within the screen housing 5.

Figure 2:
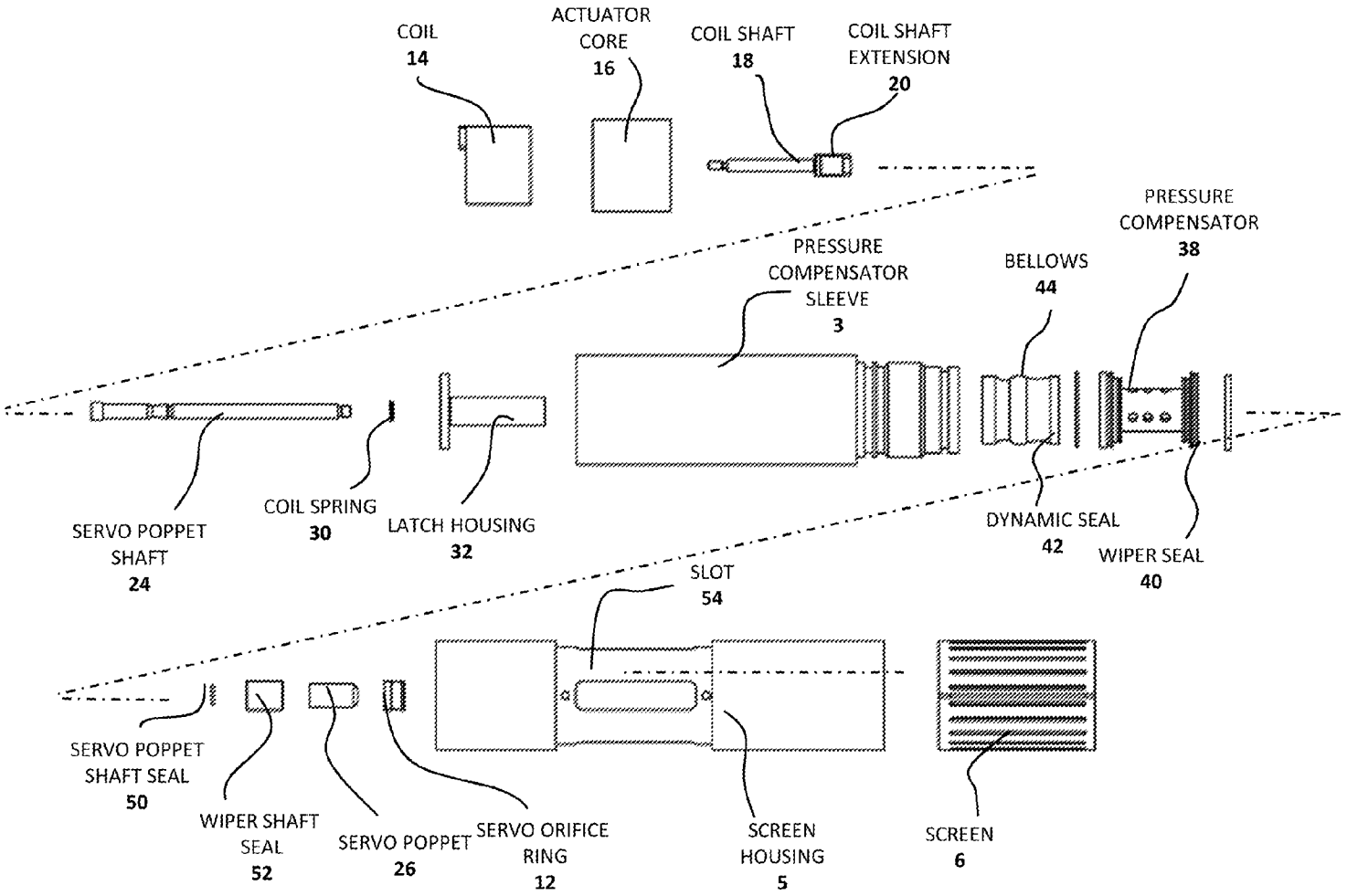
FIG. 2 is an exploded view of the components of the actuator 10.

To more clearly show selected mechanical components contained within the body of the tool, a partial exploded view is shown in FIG. 2. The components shown are those which are contained within the inset 2-3 of FIG. 1B. After a brief description of this exploded view, the arrangements of components and their functions will be described in more detail in FIGS. 3A and 3B which represent a magnified view of the inset 2-3 of FIG. 1B.

Returning now to FIG. 2, it is seen that the exploded view includes the coil 14, the actuator core 16, the coil shaft 18 (which is connected to the coil 14) and which includes a coil shaft extension 20, a coil spring 30 forming part of a latch mechanism which resides within a slot in a latch housing 32. All of these components reside within the pressure compensator sleeve 3, which also holds the pressure compensator 38 which is in the form of a piston in this embodiment. A flexible bellows sleeve 44 is fitted over the pressure compensator 38. The pressure compensator 38 also is fitted with a dynamic seal 42 and a wiper seal 40, the functions of which will be described in more detail hereinbelow. There is also provided a servo poppet shaft seal 50, and wiper shaft seal 52 between the end of the servo poppet shaft 24 and the servo poppet 26. A servo orifice ring 12 is also held within the screen housing 5. The screen 6 is placed on a reduced diameter portion of the screen housing 5 which has a wide slot 54 to allow entrance of mud which drives opening of the main valve (not shown) when the servo orifice is open by virtue of the servo poppet 26 moving away from the servo orifice ring 12.

Figure 3A:
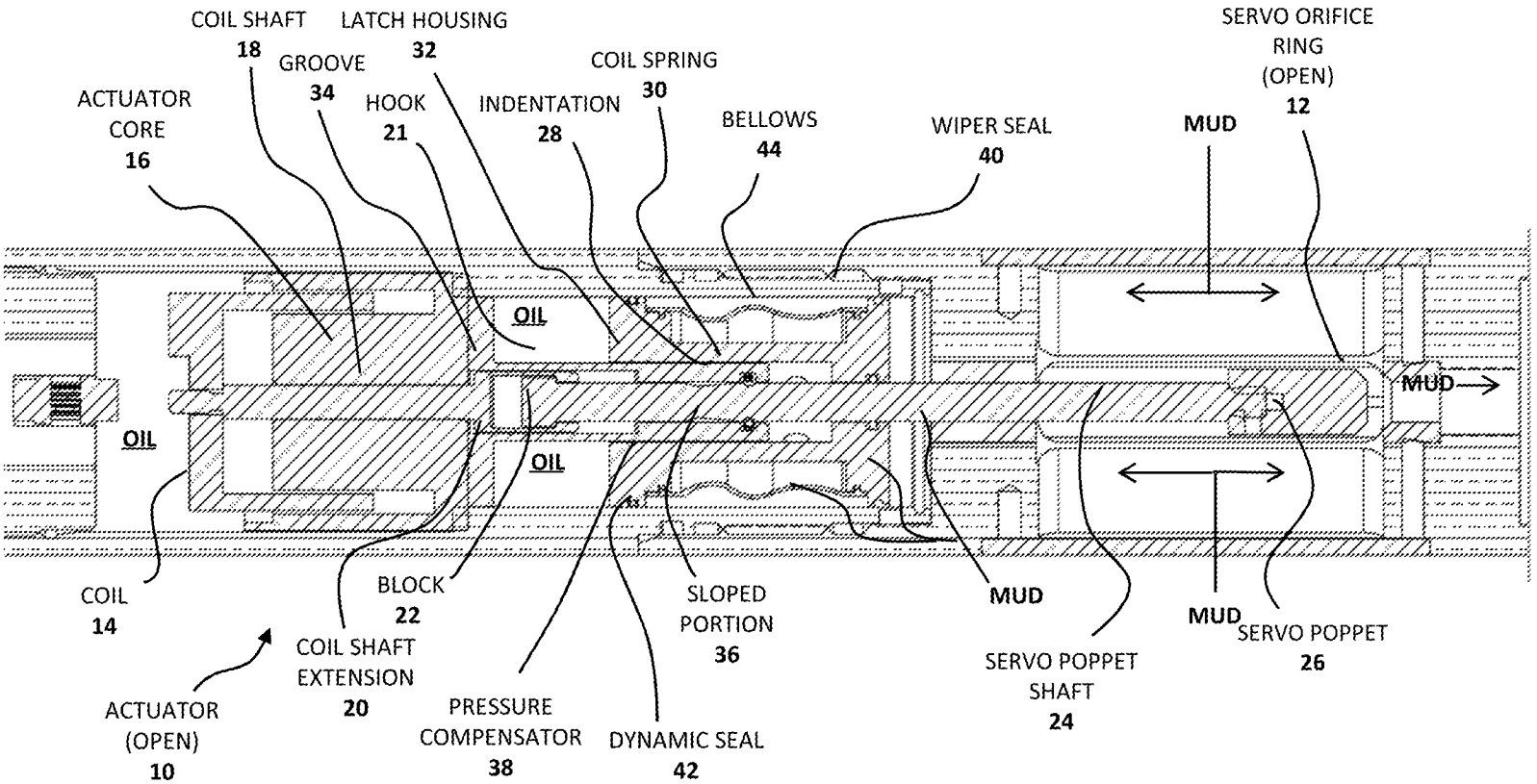
FIG. 3A is a magnified view of box 2-3 of FIG. 1B showing the actuator 10 with its servo poppet shaft 24 retracted and the servo orifice 12 open.
Figure 3B:
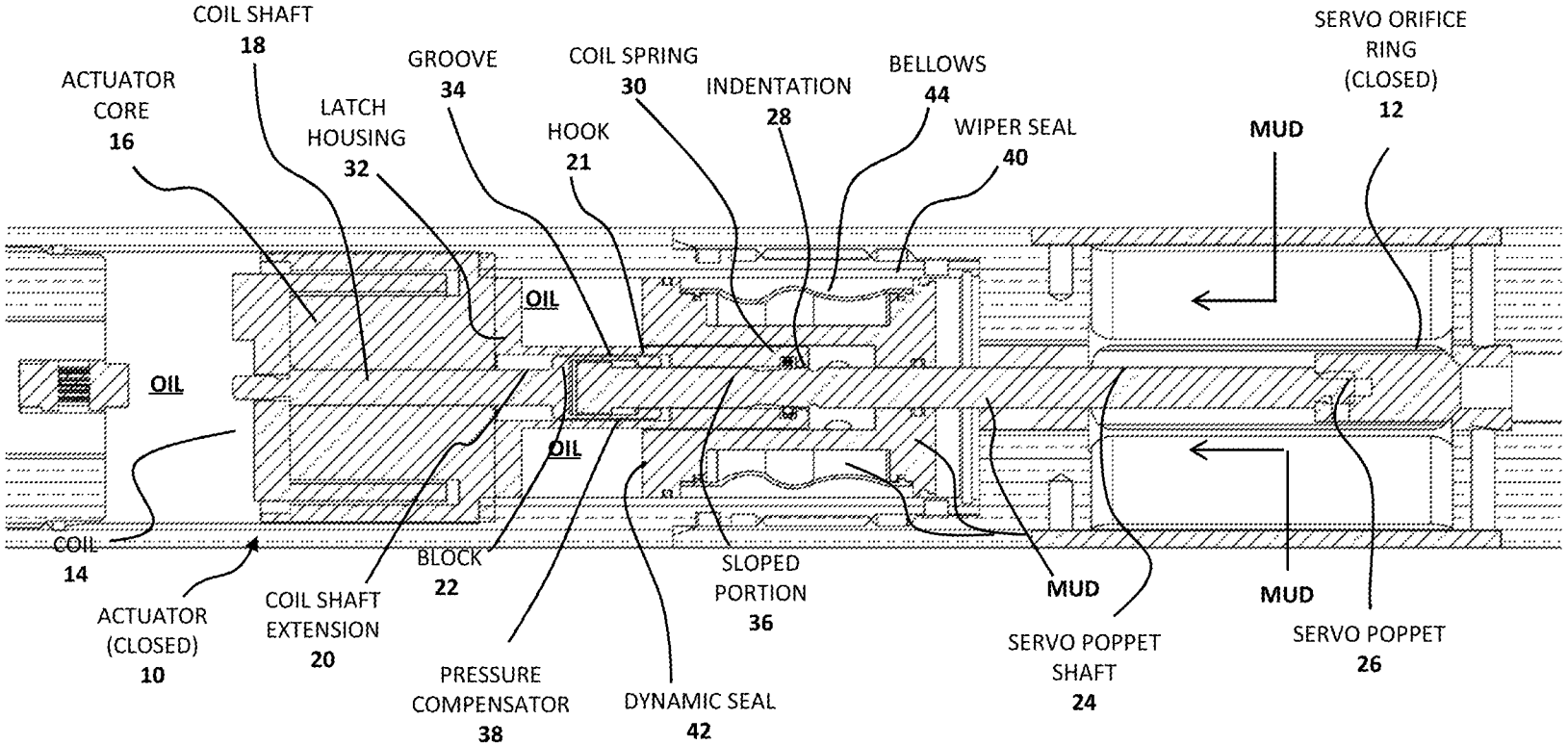
FIG. 3B a magnified view of box 2-3 of FIG. 1B showing the actuator 10 as with its servo poppet shaft 24 extended and the servo orifice 12 closed.

In FIGS. 3A and 3B, there is shown a magnified view of inset 2-3 of FIG. 1B. These views are used to more clearly show how the components are connected and to describe their functions. FIG. 3A shows the actuator 10 in an open state where mud flows through the servo orifice ring 12 and causes opening of the main pulser valve (not shown). The actuator 10 of FIGS. 3A and 3B is actuated by signals encoding data received from the measurement-while-drilling system (not shown). The signals provide instructions to switch the polarity of the magnetic field generated by a bidirectional solenoid coil 14 and actuator core 16. The magnetic field causes movement of a coil shaft 18 as the basis of opening and closing of the actuator 10 because the coil shaft 18 is connected to the coil 12. In some embodiments the solenoid coil is a voice coil of the form used in a loudspeaker cone which provides motive force to the cone by the reaction of a magnetic field to the current passing through it. In some embodiments, the voice coil is provided as part of a cylindrical frameless linear voice coil actuator marketed by BEI Kimco (Vista, Calif., USA, http://www-.beikimco.com, incorporated herein by reference in its entirety).

Features of the coil shaft 18 will now be described. The coil shaft 18 includes a hollow coil shaft extension 20 which has a groove 34 for insertion (during assembly of the actuator 10) of a poppet shaft block 22 formed at the left end of the servo poppet shaft 24. The block 22 slides within the groove during transitions from the open to closed state and vice versa. The end of the coil shaft extension 20 includes a hook 21 which is configured to grab the inner corners of the block 22 (where the block 22 is joined to the remainder of the servo poppet shaft 24) when the coil shaft 18 moves from right to left, thereby pulling the poppet shaft 24 to the left. The opposite end of the servo poppet shaft 24 is connected to a servo poppet 26 whose function is to open and close the servo orifice 12.

Additional features of the servo poppet shaft 24 include features relating to a latching mechanism. In this particular embodiment, the servo poppet shaft 24 has a circumferential indentation 28 which is configured to cooperate with a coil spring 30 which resides in a circumferential cavity in the inner sidewall of a latch housing 32 connected to the actuator core 16. In certain embodiments, the coil spring is a canted coil spring whose biasing force is readily calculated. One example of a canted coil spring design is the Bal Spring™ canted coil spring manufactured by Bal Seal Engineering Inc. of Foothills Ranch, Calif., USA; http://www.balseal.com/springs, incorporated herein by reference in its entirety). A specific biasing force for the latch may be thus conveniently selected.

FIG. 3A shows the actuator 10 in the open position with the servo orifice 12 open and mud flowing therethrough. In this open position, the coil spring 30 has dropped into the indentation 28 and is biasedly held in that latched position. The actuator 10 is thus biased in the open position in FIG. 3A. The coil spring 30 serves as a means for controlling the force required to engage and disengage the latching mechanism. A highly rigid coil spring will require more force to engage/disengage than a less rigid spring. Ranges of force required for engagement/disengagement of the latching mechanism may be determined by the skilled person without undue experimentation having regard to the intended parameters for operation of the servo valve actuator. An advantage associated with the latching mechanism is that, when latched, there is no energy requirement for maintaining the latched position, as required for a number of conventional servo valves in mud pulse telemetry systems.

The servo poppet shaft 24 of this embodiment also has a sloped portion 36 which slopes downward from right to left (as seen in FIGS. 3A and 3B) for the purpose of facilitating sliding movement of the coil spring 30 while the servo poppet shaft 24 moves from left to right during the transition from the open state (FIG. 3A) to the closed state (FIG. 3B).

Another feature of this particular embodiment is the presence of the pressure compensator 38 which, in this particular embodiment is a piston-like device which provides a mobile interface between the mud filled compartments on the right side of the valve and the oil filled compartment on the left side of the valve surrounding the components including the coil 14, the actuator core 16 and the latch housing 32. The purpose of the oil filled compartment is to counter-balance the mud pressure and prevent excessive stress on the servo poppet shaft which would otherwise occur with rapid changes in mud pressure in the absence of a pressure compensating mechanism. The pressure compensator 38 slides within the cavity of the tool in a manner responsive to the balance between oil pressure and mud pressure. The pressure compensator 38 includes a wiper seal 40 and a dynamic seal 42 against the inner sidewall of the cavity. The wiper seal 40 allows entrance of mud into the cavity formed by the inner sidewall of the tool and the body of the pressure compensator 38 but prevents entry of significant particulate matter which may damage the body of the pressure compensator 38. In some embodiments, a second wiper seal is provided adjacent to the dynamic seal to provide further protection to the dynamic seal in case particulate matter penetrates the first wiper seal 40. The pressure compensator includes an interior bellows surface 44 between the two seals 40 and 42 formed of flexible material which will flex inward with exertion of mud pressure. In some embodiments, the bellows 44 is formed of a synthetic rubber compound such as Viton or other elastomeric polymer resistant to components of drilling mud. The bellows 44 provides additional flexibility to the pressure compensator 38 and allows it to absorb small volumetric changes.

During operation of the actuator 10 from the open position (FIG. 3A) to the closed position (FIG. 3B), electrical signals from the data pulse controller (not shown) reach the coil and switch the magnetic field generated by the current, causing the coil 14 and its attached coil shaft 18 to move to the right. With the movement of the coil shaft 18 to the right, the left end wall of the groove 34 in the coil shaft extension 20 will move to the right and impact the left surface of the poppet shaft block 22 at the left end of the servo poppet shaft 24. This effect is similar to a hammer on a nail and is referred to herein as a "slide hammer mechanism." The impact drives the servo poppet shaft 24 to the right with amplified force relative to the force provided by simple movement of the coil shaft 18 itself driven by the movement of the coil 14 to the right. This amplified force is needed to disengage the latching mechanism provided by the coil spring 30 residing in the indentation 28 of the servo poppet shaft 24. Once disengaged, the servo poppet shaft 24 moves to the right and its sloped portion 36 slides against the coil spring 30 to provide additional biasing force in moving the servo poppet shaft 24 to the right. It is seen in FIG. 3B that the movement of the servo poppet shaft 24 to the right places the servo poppet 26 in a blocking position at the servo orifice ring 12. This blocking position represents the closed position. This closed position prevents mud flow through the servo orifice 12 and the result is that the main valve (not shown) remains open rather than in the mud flow-restricted position (or pulse generating position).

The reverse movement of the actuator 10 from the closed position (FIG. 3B) to the open position (FIG. 3A) will now be briefly described. A signal to reverse the polarity of the coil 14 is received at the coil 14. The coil 14 then moves to the left in response to the switching of polarity. The connected coil shaft 18 also moves to the left and the hook 21 of the coil shaft extension 20 grabs the inner edge surfaces of the poppet shaft block 22 and exerts an amplified impact thereon, driving the poppet shaft 24 to the left with the coil spring 30 falling into the indentation 28 on the servo poppet shaft 24. This moves the servo poppet 26 to attain the servo valve open position (FIG. 3A) allowing mud flow therethrough and driving the main valve to the flow-restricted position to generate a pulse of mud for telemetry.

The skilled person will recognize that a number of modifications are possible. For example, the block and extension/groove/hook arrangement provided as the basis for the slide hammer mechanism may be reversed so that the block portion resides on the end of the coil shaft and the groove extension resides on the adjacent end of the servo poppet shaft. Additionally, in alternative embodiments, the coil spring resides permanently in a groove in the poppet shaft and the latching mechanism includes a circumferential indentation in the latch housing. Such modifications may be constructed by the skilled person without undue experimentation and are intended to be within the scope of the claims.

In certain embodiments, the coil is a voice coil rather than a conventional solenoid coil. In combination with activation by an H-bridge, the current is decayed very rapidly and the duration of current required to move the coil is estimated to be approximately 20 ms to move the coil shaft over the entire distance. Additionally, the H-bridge recirculating diodes drain the back EMF current so it can be efficiently reversed. This differs from a conventional solenoid system which uses an iron core and more current to create a magnetic field. The use of a rare earth magnet in combination with the voice coil improves the magnetomotive force and reduces recovery times.

Solenoid-Based Actuator as the Main Mud Pulse Generator

Another possible embodiment is that instead of acting as a servo valve to control a main pulser valve, the valve described hereinabove fulfills both functions of translating pulse signals and directly restricting the main orifice to generate mud pulses. As such, the valve does not function as a servo valve in this embodiment, but instead is a direct actuator of the main orifice to restrict or open the mud flow to generate mud pulses. In this particular embodiment, there is a solenoid system comprising a coil and actuator core, a coil shaft, and a poppet shaft with a slide hammer mechanism and latching arrangement as described above. The poppet shaft of this embodiment extends to the main orifice of the tool for restricting flow through the orifice in generation of mud pulses instead of acting as a servo valve to control a main valve. The simplicity of having fewer moving parts and simple electronics provides the advantage of achieving the same net result as more complex systems.

Features of Electronic Control Systems

Certain embodiments of the invention include electronic control systems configured for controlling one or more embodiments of the actuator of the invention. Such control systems include features described herein which may be retrofitted into existing control systems for mud pulse telemetry tools. In alternative embodiments, custom-designed control systems are provided which incorporate the features described herein. In both cases, appropriate configurations of the control systems may be designed and tested by the skilled person without undue experimentation.

H-Bridge and Microcontroller—The H-bridge is incorporated to switch the direction of voltage across the coil under instruction from the control system. The switching of voltage is responsible for switching the poppet shaft of the actuator from the extended position to the retracted position and vice versa. The switching instructions are provided by a microcontroller which provides timing and logic output based on input from the measurement-while-drilling data collection system. The H-bridge is also responsible for reducing cycle time.

Flow Switch—The flow switch consists of a 2-axis accelerometer integrated into the downhole pulser circuit board which outputs a signal proportional to movement on the X and Y axis into a micro controller. These outputs are summed and a moving average algorithm applied to evaluate if the tool is moving or stationary. A logic or digital signal is sent from the pulser out to the measurement-while-drilling tool string processor to indicate if mud is flowing past the tool. The flow switch also places the microcontroller into a low power mode between flow states to further improve efficiency Equivalents and Scope Other than described herein, or unless otherwise expressly specified, all of the numerical ranges, amounts, values and percentages, such as those for amounts of materials, elemental contents, times and temperatures, ratios of amounts, and others, in the following portion of the specification and attached claims may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Any patent, publication, internet site, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Unless otherwise defined, all technical and scientific terms used herein have the same meaning as commonly understood by one of ordinary skill in the art to which this invention belongs.

While this invention has been particularly shown and described with references to embodiments thereof, it will be understood by those skilled in the art that various changes in form and details may be made therein without departing from the scope of the invention encompassed by the appended claims.

The invention claimed is:

1. An actuator for a mud pulse telemetry tool, the actuator comprising a solenoid-based servo valve with a bidirectional voice coil and a coil shaft connected to the voice coil, the coil shaft responsive to data transmitted by a data processor, the coil shaft movable between an extended position and a retracted position, wherein movement of the coil shaft to the extended position moves a poppet to close a servo orifice thereby preventing mud flow to a main mud pulse valve of the mud pulse telemetry tool and movement of the coil shaft to the retracted position moves the poppet to open the servo orifice thereby allowing mud flow to actuate the main mud pulse valve, wherein the poppet is connected to a poppet shaft and the poppet shaft cooperates with the coil shaft in a slide hammer mechanism to amplify force provided by the coil shaft against the poppet shaft with linear movement of the coil shaft to the extended position and to the retracted position.

2. The actuator of claim 1 wherein the coil shaft has an outer end with a hollow portion defined by an end wall and an opposing hooked end and the poppet shaft has a block dimensioned to slide within the hollow portion of the coil shaft between the end wall of the coil shaft and the opposing hooked end of the coil shaft, wherein impact of the end wall against the block resulting from movement of the coil shaft to the extended position increases the force provided by the coil shaft on the poppet shaft during closure of the servo orifice and wherein impact of the hooked end of the coil shaft against the block resulting from movement of the coil shaft to the retracted position increases the force of the coil shaft against the poppet shaft during opening of the servo orifice.

3. The actuator of claim 2, wherein the hollow portion of the coil shaft has an opening of sufficient size to allow insertion of the block of the poppet shaft, thereby facilitating assembly of the servo valve.

4. The actuator of claim 1, further comprising a latch housing for the outer end of the coil shaft and the poppet shaft, the housing cooperating with one or more shaped portions of the poppet shaft in providing a latch mechanism for retaining the poppet shaft in the extended position or the retracted position.

5. The actuator of claim 4, wherein the latch housing includes a circumferential cavity holding a coil spring and the poppet shaft includes a circumferential indentation configured to retain the spring there within with a spring-biasing force when the latch mechanism is engaged, thereby arresting linear movement of the poppet shaft.

6. The actuator of claim 5, wherein the latch mechanism is engaged when the poppet shaft is in the retracted position and the servo orifice is closed.

7. The actuator of claim 6, wherein the poppet shaft includes a downward slope away from the circumferential indentation, wherein cooperation of biasing force of the coil spring against the downward slope biases movement of the poppet shaft to the extended position.

8. The actuator of claim 1, further comprising a pressure compensating sealing device defining a boundary between an oil-containing cavity and a mud-containing cavity, the sealing device configured to move in response to changes in mud pressure and to allow linear movement of the poppet shaft.

9. The actuator of claim 8, wherein the sealing device has an interior mud-contacting surface formed of an elastomeric material which flexes in response to increased mud pressure.

10. The actuator of claim 9, wherein the sealing device includes a flexible seal allowing entrance of mud to the mud contacting surface while preventing entrance of particulate matter to the mud contacting surface.

11. The actuator of claim 10, wherein the sealing device includes a rigid seal forming a barrier between the oil-containing cavity and the mud-containing cavity and a second flexible seal adjacent the rigid seal.

12. The actuator of claim 1, wherein the voice coil is configured for movement within an actuator core comprising a rare earth magnet.

13. An actuator for a mud pulse telemetry tool, the actuator comprising a solenoid-based servo valve with a bidirectional coil and a coil shaft connected to the coil, the coil shaft responsive to data transmitted by a data processor, the coil shaft movable between an extended position and a retracted position, wherein movement of the coil shaft to the extended position moves a poppet to close or restrict an orifice of the mud pulse telemetry tool and movement of the coil shaft to the retracted position moves the poppet to open the orifice thereby allowing mud flow to actuate the mud pulse valve, wherein the poppet is connected to a poppet shaft and the poppet shaft cooperates with the coil shaft in a slide hammer mechanism to amplify force provided by the coil shaft against the poppet shaft with linear movement of the coil shaft to the extended position and to the retracted position.

14. The actuator of claim 13, wherein the coil shaft has an outer end with a hollow portion defined by an end wall and an opposing hooked end and the poppet shaft has a block dimensioned to slide within the hollow portion of the coil shaft between the end wall of the coil shaft and the opposing hooked end of the coil shaft, wherein impact of the end wall against the block resulting from movement of the coil shaft to the extended position increases the force provided by the coil shaft on the poppet shaft during closure of the orifice and wherein impact of the hooked end of the coil shaft against the block resulting from movement of the coil shaft to the retracted position increases the force of the coil shaft against the poppet shaft during opening of the orifice.

15. The actuator of claim 14, wherein the hollow portion of the coil shaft has an opening of sufficient size to allow insertion of the block of the poppet shaft, thereby facilitating assembly of the valve.

16. The actuator of claim 13, further comprising a latch housing for the outer end of the coil shaft and the poppet shaft, the housing cooperating with one or more shaped portions of the poppet shaft in providing a latch mechanism for retaining the poppet shaft in the extended position or the retracted position.

17. The actuator of claim 16, wherein the latch housing includes a circumferential cavity holding a coil spring and the poppet shaft includes a circumferential indentation configured to retain the spring therewithin with a spring-biasing force when the latch mechanism is engaged, thereby arresting linear movement of the poppet shaft.

18. The actuator of claim 17, wherein the latch mechanism is engaged when the poppet shaft is in the retracted position and the orifice is closed or restricted.

19. The actuator of claim 18, wherein the poppet shaft includes a downward slope away from the circumferential indentation, wherein cooperation of biasing force of the coil spring against the downward slope biases movement of the poppet shaft to the extended position.

20. The actuator of claim 16, further comprising a pressure compensating sealing device defining a boundary between an oil-containing cavity which houses the coil shaft and at least a portion of the latch housing, and a mud-containing cavity, the sealing device configured to move in response to changes in mud pressure.

21. The actuator of claim 20, wherein the sealing device has an interior mud-contacting surface formed of an elastomeric material which flexes in response to increased mud pressure.

22. The actuator of claim 21, wherein the sealing device includes a flexible seal allowing entrance of mud to the mud contacting surface while preventing entrance of particulate matter to the mud contacting surface.

23. The actuator of claim 22, wherein the sealing device includes a rigid seal forming a barrier between the oil-containing cavity and the mud-containing cavity and a second flexible seal adjacent the rigid seal.

24. The actuator of claim 13, wherein the coil is configured for movement within an actuator core comprising a rare earth magnet.

25. An actuator for a mud pulse telemetry tool, the actuator comprising a solenoid-based servo valve with a bidirectional voice coil and a coil shaft connected to the voice coil, the coil shaft responsive to data transmitted by a data processor, the coil shaft movable between an extended position and a retracted position, wherein movement of the coil shaft to the extended position moves a poppet to close a servo orifice thereby preventing mud flow to a main mud pulse valve of the mud pulse telemetry tool and movement of the coil shaft to the retracted position moves the poppet to open the servo orifice thereby allowing mud flow to actuate the main mud pulse valve, wherein the poppet is connected to a poppet shaft and the poppet shaft cooperates with the coil shaft in a slide hammer mechanism to amplify force provided by the coil shaft against the poppet shaft with linear movement of the coil shaft to the extended position and to the retracted position, wherein a portion of the poppet shaft resides in a latch housing which cooperates with one or more shaped portions of the poppet shaft in providing a latch mechanism for retaining the poppet shaft in the extended position or the retracted position.

26. The actuator of claim 25, wherein the latch housing includes a circumferential cavity holding a coil spring and the poppet shaft includes a circumferential indentation configured to retain the spring therewithin with a spring-biasing force when the latch mechanism is engaged, thereby arresting linear movement of the poppet shaft.

27. The actuator of claim 26, wherein the latch mechanism is engaged when the poppet shaft is in the retracted position and the servo orifice is closed.

28. The actuator of claim 25, wherein the coil shaft has an outer end with a hollow portion defined by an end wall and an opposing hooked end and the poppet shaft has a block dimensioned to slide within the hollow portion of the coil shaft between the end wall of the coil shaft and the opposing hooked end of the coil shaft, wherein impact of the end wall against the block resulting from movement of the coil shaft to the extended position increases the force provided by the coil shaft on the poppet shaft during closure of the servo orifice and wherein impact of the hooked end of the coil shaft against the block resulting from movement of the coil shaft to the retracted position increases the force of the coil shaft against the poppet shaft during opening of the servo orifice.

29. The actuator of claim 25, wherein the hollow portion of the coil shaft has an opening of sufficient size to allow insertion of the block of the poppet shaft, thereby facilitating assembly of the servo valve.

30. The actuator of claim 26, wherein the poppet shaft includes a downward slope away from the circumferential indentation, wherein cooperation of biasing force of the coil spring against the downward slope biases movement of the poppet shaft to the extended position.

31. The actuator of claim 25, further comprising a pressure compensating sealing device defining a boundary between an oil-containing cavity and a mud-containing cavity, the sealing device configured to move in response to changes in mud pressure and to allow linear movement of the poppet shaft.

32. The actuator of claim 31, wherein the sealing device has an interior mud-contacting surface formed of an elastomeric material which flexes in response to increased mud pressure.

33. The actuator of claim 32, wherein the sealing device includes a flexible seal allowing entrance of mud to the mud contacting surface while preventing entrance of particulate matter to the mud contacting surface.

34. The actuator of claim 33, wherein the sealing device includes a rigid seal forming a barrier between the oil-containing cavity and the mud-containing cavity and a second flexible seal adjacent the rigid seal.

35. The actuator of claim 25, wherein the voice coil is configured for movement within an actuator core comprising a rare earth magnet.

* * * * *